US009139944B2

(12) United States Patent
Kim et al.

(10) Patent No.: US 9,139,944 B2
(45) Date of Patent: Sep. 22, 2015

(54) WASHING METHOD

(75) Inventors: Dongyoon Kim, Changwon-si (KR); Youngkee Oh, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 1282 days.

(21) Appl. No.: 13/010,530

(22) Filed: Jan. 20, 2011

(65) Prior Publication Data

US 2011/0179584 A1 Jul. 28, 2011

(30) Foreign Application Priority Data

Jan. 22, 2010 (KR) ..... 10-2010-0006187

(51) Int. Cl.

| | |
|---|---|
| ***D06F 33/02*** | (2006.01) |
| ***D06F 23/04*** | (2006.01) |
| ***D06F 37/40*** | (2006.01) |
| *D06F 13/02* | (2006.01) |

(52) U.S. Cl.

CPC ..... *D06F 33/02* (2013.01); *D06F 23/04* (2013.01); *D06F 37/40* (2013.01); *D06F 13/02* (2013.01)

(58) Field of Classification Search

CPC ..... D06F 33/00; D06F 33/02
USPC ..... 8/158, 159; 68/12.06, 12.12
See application file for complete search history.

(56) References Cited

U.S. PATENT DOCUMENTS

| | | | | |
|---|---|---|---|---|
| 4,784,666 | A * | 11/1988 | Brenner et al. | 8/137 |
| 5,230,228 | A * | 7/1993 | Nakano et al. | 68/12.04 |
| 6,247,339 | B1 * | 6/2001 | Kenjo et al. | 68/12.04 |
| 6,351,974 | B1 * | 3/2002 | Lyu et al. | 68/148 |
| 7,047,770 | B2 * | 5/2006 | Broker et al. | 68/12.16 |
| 7,376,997 | B2 * | 5/2008 | Kim et al. | 8/159 |
| RE40,732 | E * | 6/2009 | Jeon et al. | 8/158 |

FOREIGN PATENT DOCUMENTS

| | | |
|---|---|---|
| AU | 2010249169 A1 | 6/2011 |
| CA | 2 723 094 A1 | 6/2011 |
| WO | WO2010/030108 A2 | 3/2010 |

* cited by examiner

*Primary Examiner* — Joseph L Perrin
*Assistant Examiner* — Kevin G Lee
(74) *Attorney, Agent, or Firm* — Birch, Stewart, Kolasch & Birch, LLP

(57) ABSTRACT

Disclosed is a washing method in which an inner tub or a pulsator is operated in various ways to achieve reduced abrasion of laundry and enhanced washing performance. The washing machine includes a disentangling washing operation during which the inner tub is alternately rotated in forward and reverse directions to disentangle laundry received in the inner tub, a tapping washing operation, subsequent to the disentangling washing operation, during which the inner tub is successively rotated in a given direction such that the laundry is adhered to an inner surface of the inner tub and the wash water is raised along a path between the outer tub and the inner tub to thereby flow into the inner tub by centrifugal force generated during rotation of the inner tub, and an agitation washing operation, subsequent to the tapping washing operation, during which the pulsator is alternately rotated in forward and reverse directions.

7 Claims, 8 Drawing Sheets

WASHING METHOD

CROSS-REFERENCE TO RELATED APPLICATION

The present application claims priority to Korean Application No. 10-2010-0006187 filed in Korea on Jan. 22, 2010 , the entire contents of which are hereby incorporated by reference in their entirety.

BACKGROUND OF THE INVENTION

1 . Field of the invention

The present invention relates to a washing method, and more particularly, to a washing method capable of enhancing washing performance by controlling rotation of an inner tub and/or a pulsator in various ways.

2 . Description of the Related Art

Generally, a washing machine is an apparatus functioning to remove contaminants adhered to clothing, bedding, and the like (hereinafter, referred to as "laundry") using chemical decomposition action of detergents dissolved in water and using physical action, such as friction between water and laundry.

A conventional washing machine is designed to wash laundry by sequentially performing a washing operation, a rinsing operation, and a dehydrating operation. The washing machine may perform a selected one of such operations based on user selection, and may perform washing of laundry according to various preset courses in consideration of the kind of laundry.

Laundry is washed by, e.g., friction between laundry and a pulsator and water streams generated by rotation of the pulsator and/or an inner tub. Thus, to enhance washing performance, it may be important to appropriately control rotation of the pulsator and/or the inner tub. Failure to appropriately control rotation may cause several problems, such as abrasion of laundry, poor washing performance, performance deterioration due to overheating of a motor, excessive power consumption and/or excessive washing time.

SUMMARY OF THE INVENTION

Therefore, the present invention has been made in view of the above problems, and it is an object of the present invention to provide a washing method capable of enhancing washing performance by controlling rotation of an inner tub and/or a pulsator in various ways during washing of laundry.

In accordance with one aspect of the present invention, the above and other objects can be accomplished by the provision of a washing method of a washing machine including an outer tub in which wash water is received, an inner tub rotatably provided in the outer tub such that wash water and laundry are received therein, and a pulsator rotatably provided in a lower region of the inner tub, the washing method including performing a disentangling washing operation during which the inner tub is alternately rotated in forward and reverse directions such that the laundry received in the inner tub is disentangled, performing a tapping washing operation, subsequent to the disentangling washing operation, during which the inner tub is successively rotated in a given direction such that the laundry is adhered to an inner surface of the inner tub and the wash water is raised along a path between the outer tub and the inner tub to thereby flow into the inner tub by centrifugal force generated during rotation of the inner tub, and performing an agitation washing operation, subsequent to the tapping washing operation, during which the pulsator is alternately rotated in forward and reverse directions.

In accordance with another aspect of the present invention, there is provided a washing method of a washing machine including an outer tub in which wash water is received, an inner tub rotatably provided in the outer tub such that wash water and laundry are received therein, and a pulsator rotatably provided in a lower region of the inner tub, the washing method including high concentration washing performed in a state in which the wash water received in the outer tub is kept at a preset water level or less, wherein the high concentration washing includes a disentangling washing operation during which the inner tub is alternately rotated in forward and reverse directions to disentangle the laundry received in the inner tub, a successive rotating operation during which the inner tub is successively rotated in a given direction such that the laundry is adhered to an inner surface of the inner tub by centrifugal force generated during rotation of the inner tub, and an agitation washing operation during which the pulsator is alternately rotated in forward and reverse \ directions, and wherein the washing method further includes, subsequent to the high concentration washing, low concentration washing in which at least one of the inner tub and the pulsator is rotated in a state in which wash water is additionally supplied such that the wash water in the outer tub exceeds the preset water level.

The foregoing and other objects, features, aspects and advantages of the present invention will become more apparent from the following detailed description of the present invention when taken in conjunction with the accompanying drawings.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

Reference will now be made in detail to exemplary embodiments of the present invention, examples of which are illustrated in the accompanying drawings. Wherever possible, the same reference numbers will be used throughout the drawings to refer to the same or like parts.

Figure 1:
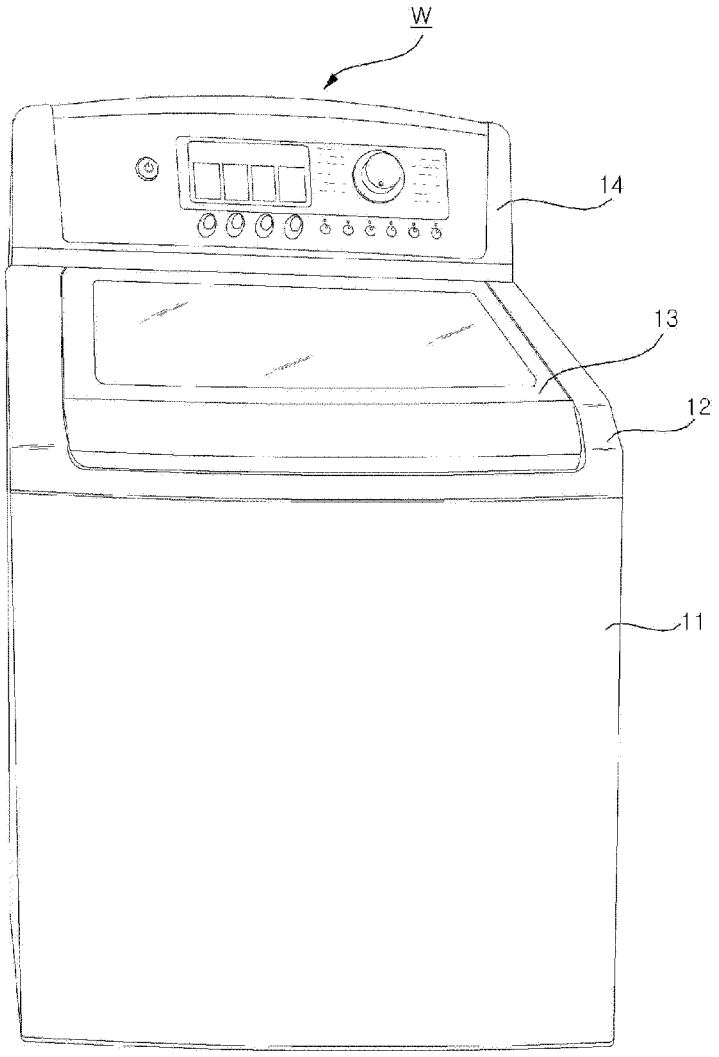
FIG. 1 is a perspective view of a washing machine according to an embodiment of the present invention.
Figure 2:
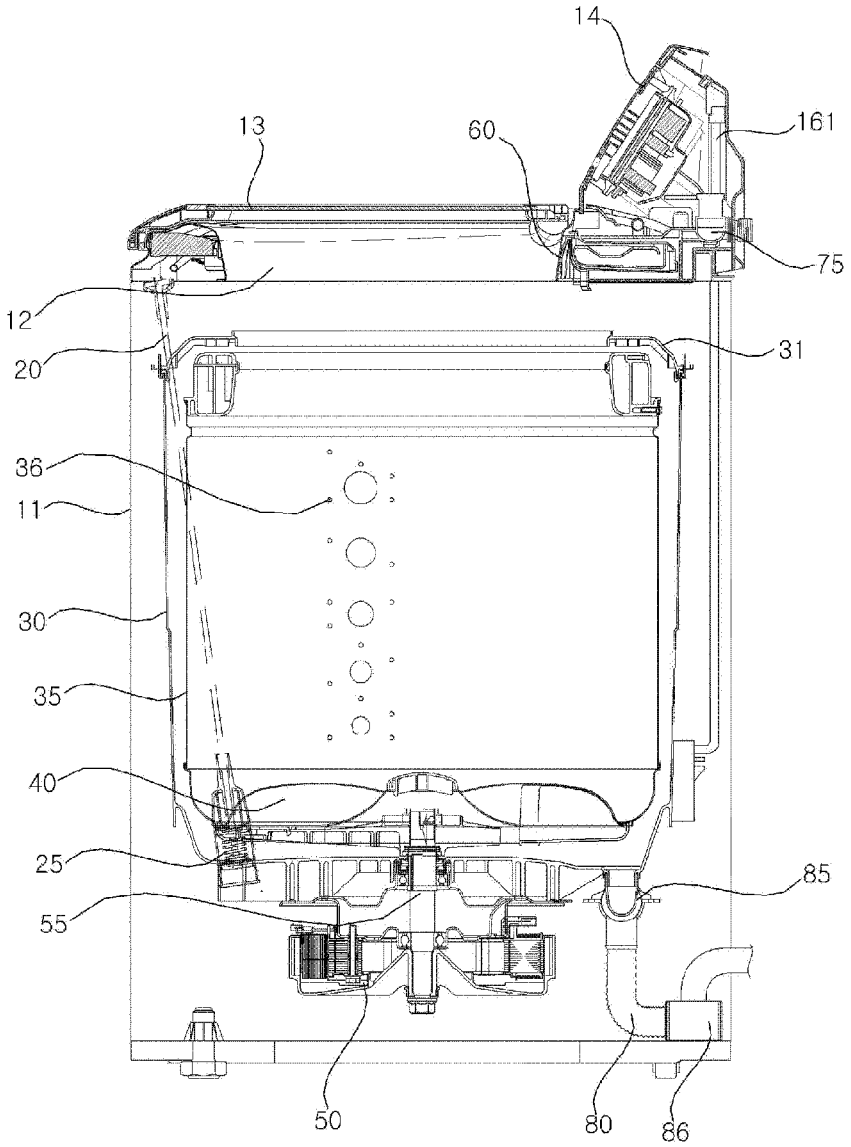
FIG. 2 is a side sectional view illustrating an interior configuration of the washing machine illustrated in FIG. 1.
Figure 3:
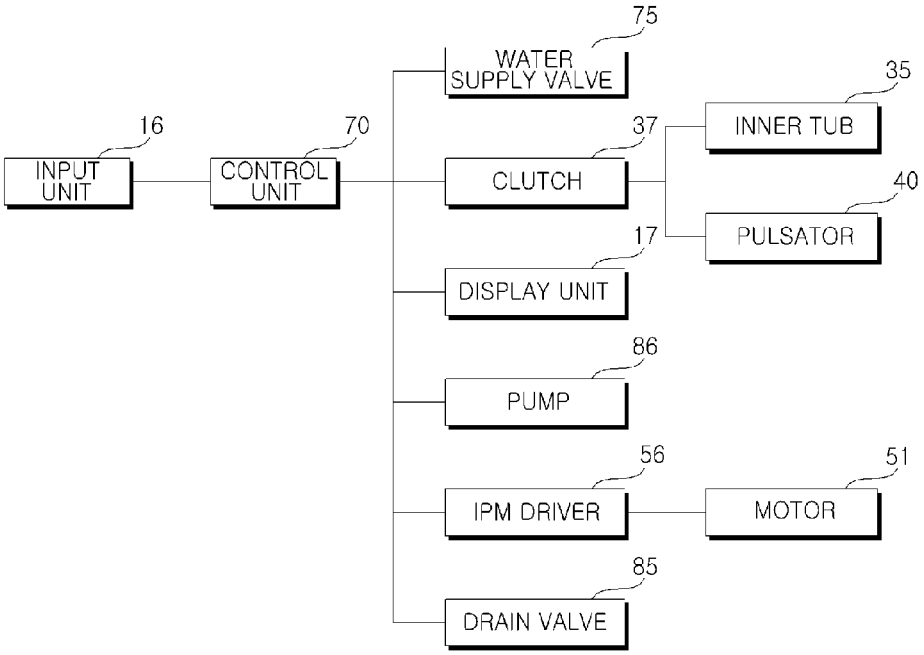
FIG. 3 is a block diagram illustrating a relationship between major parts of the washing machine illustrated in FIG. 1.

FIG. 1 is a perspective view of a washing machine according to an embodiment of the present invention, FIG. 2 is a side sectional view illustrating an interior configuration of the washing machine illustrated in FIG. 1, and FIG. 3 is a block diagram illustrating a relationship between major parts of the washing machine illustrated in FIG. 1.

Referring to FIGS. 1 to 3, the washing machine W according to the embodiment of the present invention includes a cabinet 11 having an open upper end, a top cover 12 coupled to the upper end of the cabinet 11 and having a laundry entrance/exit hole through which laundry is put into or taken out of the washing machine W, a door 13 pivotally mounted to the top cover 12 to open or close the laundry entrance/exit hole, an outer tub 30 suspended to the top cover 12 by a supporting member 20 and configured to receive wash water therein, a damper 25 connecting the supporting member 20 and the outer tub 30 to each other to alleviate vibration generated during operation of the washing machine W, an outer tub cover 31 coupled to an upper end of the outer tub 30 and having a center opening for passage of laundry and/or wash water, an inner tub 35 rotatably provided in the outer tub 30 and configured to receive laundry therein, a pulsator 40 rotatably provided in the inner tub 35, and a drive unit 50 to supply drive power to the inner tub 35 and/or the pulsator 40.

The drive unit 50 may include a motor 51 to generate rotation power. The rotation power generated by the motor 51 is transmitted through a rotating shaft 55 to cause rotation of the inner tub 35 and/or the pulsator 40. In this case, to selectively rotate the inner tub 35 and/or the pulsator 40, a clutch 37 may be provided to link the rotating shaft 55 and the inner tub 35 to each other or to link the rotating shaft 55 and the pulsator 40 to each other. Also, a driving driver may be provided to control rotation of the motor 51 by applying a drive signal to the motor 51 based on the control of a control unit 70.

The driving driver serves to apply a predetermined pattern of a drive signal to the motor 51, thereby allowing the motor 51 to be rotated based on the drive signal. There are various patterns of drive signals including an ON-time interval during which current is applied to the motor 51 and an OFF-time interval during which current is not applied to the motor 51.

The driving driver is selected from a drive circuit of a power device, such as a power control Metal Oxide Semiconductor Field Effect Transistor (MOSFET) or Insulated Gate Bipolar Transistor (IGBT), which is conventionally called an Intelligent Power Module (IPM) and serves to control power supply, or a power source module having a self-protecting function. Hereinafter, the driving driver will be assumed to be an IPM driver 56, by way of example.

In the meantime, as the clutch 37 is operated by the control unit 70, the pulsator 40 alone may be rotated, or the inner tub 35 and the pulsator 40 may be rotated simultaneously.

A detergent box 60, in which a variety of washing additives, such as a washing detergent, a fabric softener for rinsing, and/or a bleaching agent, are received, is mounted in the top cover 12 so as to be pushed into or pulled out of the top cover 12. Also, a water supply pipe 161 is connected to an external water source, such as a water tap, to supply wash water into the inner tub 35. A plurality of holes 36 is perforated in the inner tub 35 to enable movement of wash water between the inner tub 35 and the outer tub 30. In addition, a water supply valve 75 may be provided to switch the water supply pipe 161 on or off.

The washing machine W may further include a drain pipe 80, a drain valve 85 provided on the drain pipe 80, and a pump 86, which serve to drain the wash water from the outer tub 30.

The top cover 12 is provided with a control panel 14 to provide a user interface. The control panel 14 includes an input unit 16 to allow a user to input a variety of control commands related to general operations of the washing machine W, and a display unit 17 to display operating states of the washing machine W.

The control unit 70 controls operations of the water supply valve 75, the drain valve 85, the clutch 37, the display unit 17, the pump 86, and/or the IPM driver 56 based on the control commands input through the input unit 16 or based on preset algorithms.

If the user inputs a control command using the input unit 16, the control unit 70 controls implementation of at least one of washing, rinsing, and dehydrating cycles based on the input control command. In a washing method according to an embodiment of the present invention, to enhance washing performance during a washing cycle performed by the washing machine W, one might consider performing complex washing in which rotation patterns of at least one of the inner tub 35 and the pulsator 40 are set in various ways and at least one of the inner tub 35 and the pulsator 40 is rotated based on combinations of the preset patterns.

The complex washing may be broadly classified into two patterns, one of which involves controlling rotation of the inner tub 35, and the other one of which involves controlling rotation of the pulsator 40.

Although either of the two patterns may be performed during complex washing, in the following description, the complex washing is defined as the inner tub 35 and the pulsator 40 being rotated based on preset patterns to wash laundry via inner tub rotation control for controlling the rotation pattern of the inner tub 35 in various ways and pulsator rotation control for controlling the rotation pattern of the pulsator 40 in various ways.

In this case, it should be noted that the inner tub rotation control does not essentially require to rotate the inner tub 35 alone. That is, rotating the inner tub 35 is sufficient for the inner tub rotation control and thus, rotating the inner tub 35 and the pulsator 40 together also falls within the concept of the inner tub rotation control.

Hereinafter, various washing motions derived by the inner tub rotation control or the pulsator rotation control will be described with reference to FIGS. 4 to 9.

Figure 4:
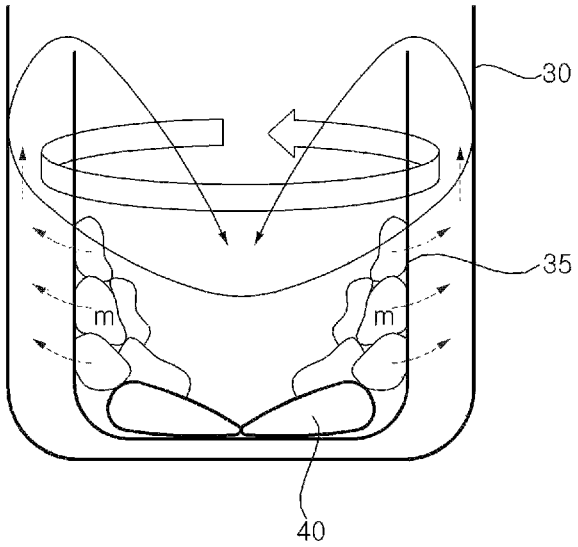
FIG. 4 is a conceptual view illustrating a tapping washing motion.

FIG. 4 is a conceptual view illustrating a tapping washing motion.

The tapping washing motion is embodied by a method of controlling rotation of the inner tub 35. The tapping washing motion is a washing motion to wash laundry using the current of wash water generated as the wash water is raised along a path between the outer tub 30 and the inner tub 35 and then, flows back into the inner tub 35. Thus, the wash water flowing back into the inner tub 35 applies strong shock to the laundry m, which results in the effect of tapping and washing the laundry m.

More specifically, the tapping washing motion is embodied by successively rotating the inner tub 35 in a given direction such that the laundry m within the inner tub 35 is adhered to an inner surface of the inner tub 35 and the wash water within the outer tub 30 is raised along the path between the outer tub 30 and the inner tub 35 to thereby be again introduced into the inner tub 35, owing to centrifugal force generated during rotation of the inner tub 35.

During the tapping washing motion, furthermore, as the wash water within the inner tub 35 moves to the outer tub 30 through the holes 36, the wash water penetrates the laundry m adhered to the inner surface of the inner tub 35, thereby acting to effectively remove contaminants between fibers of the laundry m. In particular, the above described penetration of wash water has the effect of allowing detergent dissolved in the wash water to uniformly permeate the laundry m.

Moreover, when maintaining a state in which the laundry m is adhered to the inner surface of the inner tub 35, positional displacement of the laundry does not occur and this has the effect of reducing friction between pieces of laundry and consequently, damage to the laundry.

Of course, it will be appreciated that the inner tub 35 and the pulsator 40 may be integrally rotated during the tapping washing motion.

Figure 5:
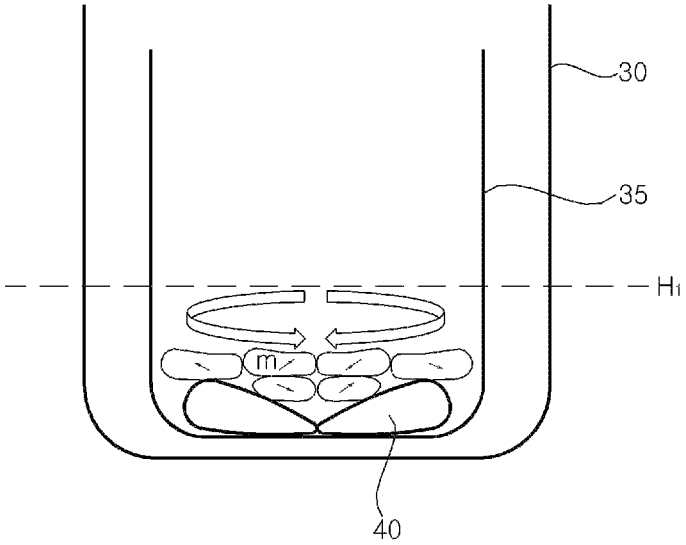
FIG. 5 is a conceptual view illustrating a rubbing washing motion.

FIG. 5 is a conceptual view illustrating a rubbing washing motion.

The rubbing washing motion is embodied by a method of controlling rotation of the pulsator 40. The rubbing washing motion is a washing motion to agitate the wash water within the inner tub 35 by repeatedly rotating the pulsator 40 in a given direction and then in the opposite direction, i.e. by alternately rotating the pulsator 40 in forward and reverse directions in a state in which the wash water within the outer tub 30 is kept at a preset water level $H_1$. In this case, to allow the laundry m within the inner tub 35 to be smoothly shaken in forward and reverse directions, it is preferable that the rate of rotation of the pulsator 40 be kept relatively low. Repeatedly shaking laundry in forward and reverse directions has the effect of rubbing and washing laundry.

The rubbing washing motion has the effect of reducing damage to laundry because the pulsator 40 is rotated at a low velocity and thus, applies relatively slight mechanical force to laundry. In particular, differently from an agitation washing motion which will be described hereinafter, during which strong mechanical force is generated to enhance washing performance, the rubbing washing motion is adapted to generate slight mechanical force, thus reducing damage to laundry.

The rubbing washing motion is preferably performed in a state in which detergent is input into a low level of wash water within the outer tub 30, in other words, such that, once dissolved, the detergent solution will be highly concentrated. In this case, even if the pulsator 40 applies slight mechanical force to the laundry m, the laundry m is washed using a highly concentrated water/detergent solution, which results in enhanced washing performance owing to chemical action of the detergent.

Figure 6A:
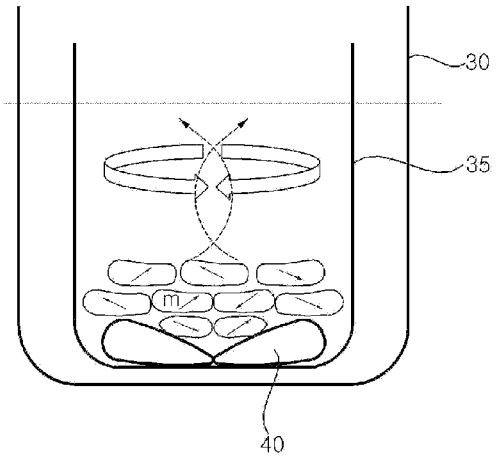
FIG. 6A is a conceptual view illustrating an agitation washing motion.

FIG. 6A is a conceptual view illustrating an agitation washing motion.

The agitation washing motion is embodied by a method of controlling rotation of the pulsator 40. The agitation washing motion is a washing motion to agitate wash water within the inner tub 35 by repeatedly rotating the pulsator 40 in a given direction and then in the opposite direction, i.e. by alternately rotating the pulsator 40 in forward and reverse directions. In this case, the pulsator 40 is rotated at a high velocity to create an upward wash water stream from the bottom to the top of the inner tub 35.

The agitation washing motion has the effect of scrubbing and washing laundry using a strong wash water stream swirling upward from the bottom of the inner tub 35 by rotation of the pulsator 40 and using strong mechanical force applied to laundry by friction between the laundry and the pulsator 40. The agitation washing motion requires a higher rate of rotation of the pulsator 40 than the above described rubbing washing motion. In the agitation washing motion, the rate of rotation of the pulsator 40 may be set to be greater than during the rubbing washing motion.

In particular, when the rotation direction of the pulsator 40 is changed, the wash water and the laundry tend to rotate in opposite directions for a certain time due to an inertia difference between the wash water and the laundry. During this time, the wash water applies strong shock to the laundry, which enables highly efficient washing of laundry.

Figure 6B:
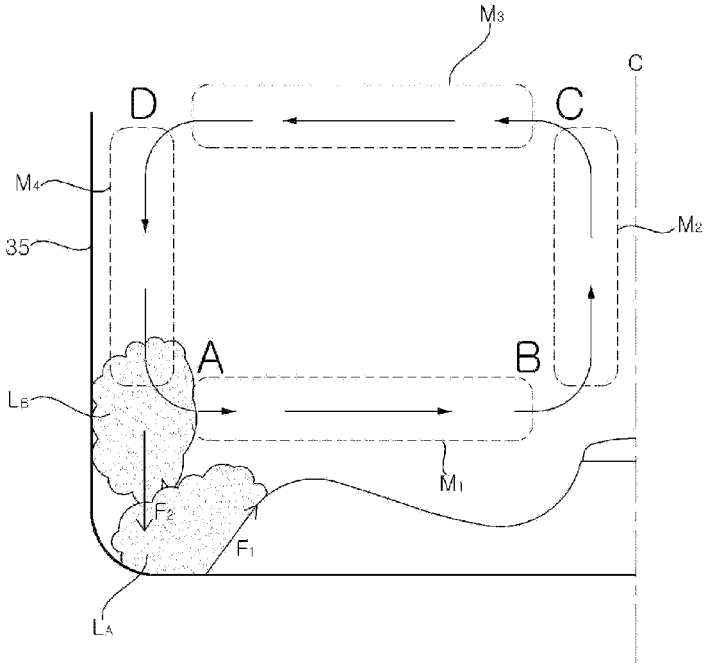
FIG. 6B is a conceptual view illustrating an inverse toroidal tumbling motion created during implementation of the agitation washing motion.

FIG. 6B is a conceptual view illustrating an inverse toroidal tumbling motion created during implementation of the agitation washing motion. Hereinafter, the inverse toroidal tumbling motion of laundry will be described with reference to FIG. 6B. As the pulsator 40 is rotated upon implementation of the agitation washing motion, laundry L is first transferred from a lower edge A of the inner tub 35 to a lower center position B of the inner tub 35 and then is raised to an upper center position C and, thereafter, is dropped after being distributed to an upper edge D, thereby tumbling as illustrated in FIG. 6B. In this case, since the circulating direction of the laundry L is opposite to that of the wash water which moves from the center position B to the edge A of the inner tub 35 by centrifugal force generated during rotation of the pulsator 40, hereinafter, movement of the laundry derived by rotation of the pulsator 40 as illustrated in FIG. 6B is referred to as an "inverse toroidal tumbling motion".

The inverse toroidal tumbling motion may be caused by various factors and, hereinafter, two factors will be described.

A first factor causing the inverse toroidal tumbling motion is frictional force generated between the laundry L and the pulsator 40.

Laundry $L_A$ located at the bottom of the inner tub 35 is subjected, at an interface with the pulsator 40, to frictional force F1 toward the center of the inner tub 35.

In this case, the magnitude of the frictional force F1 is affected by the shape of the pulsator 40, a contact area between the pulsator 40 and the laundry $L_A$, the strength/rate of rotation of the pulsator 40, and the like.

The laundry $L_A$ is moved toward the center of the inner tub 35 in a lower movement region $M_1$ by the frictional force F1 between the pulsator 40 and the laundry $L_A$. In this case, major forces acting on the laundry $L_A$ in the lower movement region $M_1$ may include the frictional force F1 between the pulsator 40 and the laundry $L_A$, the weight $F_2$ of laundry $L_B$, frictional force between the laundry $L_A$ and a bottom surface 35*a* of the inner tub 35, and centrifugal force generated by rotation of the pulsator 40.

As the laundry $L_B$ fills an empty space generated as the laundry $L_A$ is moved toward the center of the inner tub along the lower movement region $M_1$, the laundry is successively moved toward the center of the inner tub 35.

The laundry moved toward the center of the inner tub 35 is raised along a rising region $M_2$ and is moved from the center to the edge of the inner tub 35 in an upper movement region $M_3$ and then, is dropped in a drop region $M_4$. With this circulation cycle of the laundry, the inverse toroidal tumbling motion of the laundry is implemented.

Figure 7:
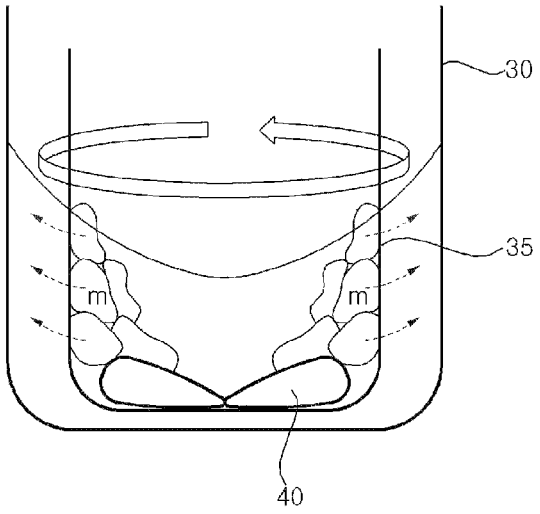
FIG. 7 is a conceptual view illustrating a penetration washing motion.

FIG. 7 is a conceptual view illustrating a penetration washing motion.

The penetration washing motion is embodied by a method of controlling rotation of the inner tub 35. Specifically, the penetration washing motion is performed by successively rotating the inner tub 35 in a given direction such that the laundry m within the inner tub 35 is adhered to the inner surface of the inner tub 35 and the wash water is moved from the inner tub 35 to the outer tub 30 through the holes 36, owing to centrifugal force generated during rotation of the inner tub 35.

In the penetration washing motion, differently from the above described tapping washing motion, the wash water raised along a path between the inner tub 35 and the outer tub 30 does not flow back into the inner tub 35. Thus, rotation of the inner tub 35 is controlled such that the wash water is raised along a path between the inner tub 35 and the outer tub 30 up to a height less than an upper end of the inner tub 35.

In the penetration washing motion, as the wash water within the inner tub 35 is moved to the outer tub 30 through the holes 36, the wash water penetrates the laundry m adhered to the inner surface of the inner tub 35, thereby acting to effectively remove contaminants between fibers of the laundry m. In particular, the above described penetration of wash water has the effect of allowing detergent dissolved in the wash water to uniformly permeate the laundry m.

In addition, when maintaining the laundry adhered to the inner surface of the inner tub 35, there occurs no positional displacement of the laundry, and this has the effect of reducing friction between pieces of the laundry and damage to the laundry.

Of course, it will be appreciated that the inner tub 35 and the pulsator 40 may be integrally rotated during the penetration washing motion.

Figure 8:
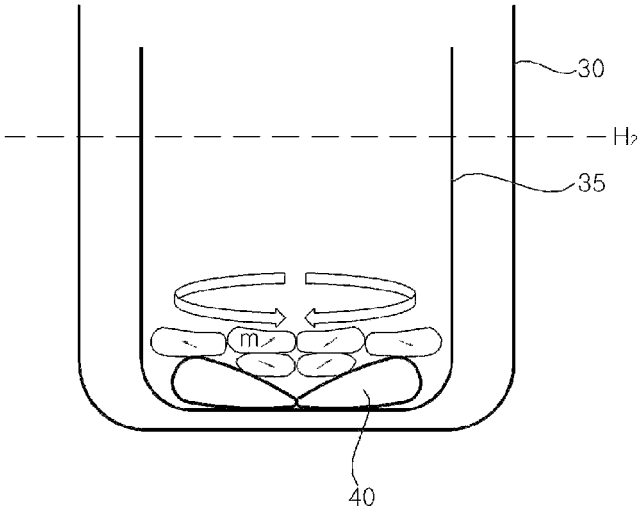
FIG. 8 is a conceptual view illustrating a shaking washing motion.

FIG. 8 is a conceptual view illustrating a shaking washing motion.

The shaking washing motion is embodied by a method of controlling rotation of the pulsator 40. Specifically, the shaking washing motion is performed by repeatedly rotating the pulsator 40 in a given direction and then in the opposite direction, in other words, by alternately rotating the pulsator 40 in forward and reverse directions. Thus, the shaking washing motion is similar to the above described rubbing washing motion in view of the driving method of the pulsator 40.

However, the shaking washing motion differs from the rubbing washing motion in the fact that the wash water is filled up to a preset or more level within the outer tub 30. Since the pulsator 40 is rotated in a state in which the wash water within the outer tub 30 is kept at a water level $H_2$ higher than that during the rubbing washing motion, a greater amount of the laundry m floats in the inner tub 35 and is shaken by wash water as compared to that in the rubbing washing motion. Thus, friction between the pulsator 40 and the laundry m is further reduced, which minimizes damage to the laundry m.

The strength/rate of rotation of the pulsator 40 in the shaking washing motion may be set differently from those of the rubbing washing motion.

Figure 9:
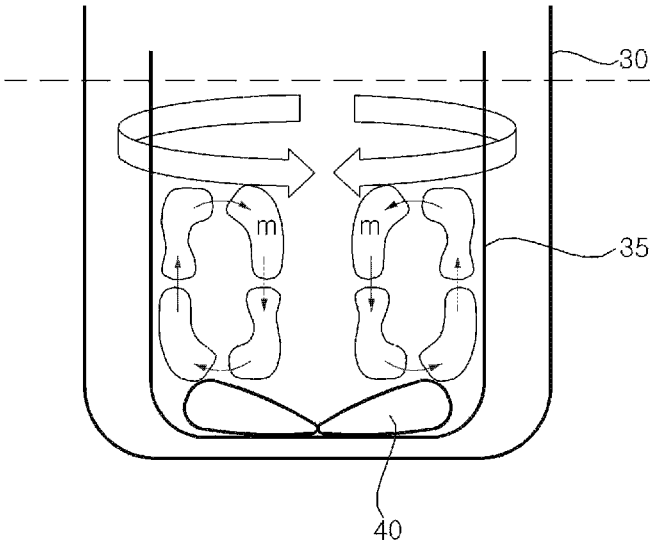
FIG. 9 is a conceptual view illustrating a disentangling washing motion.

FIG. 9 is a conceptual view illustrating a disentangling washing motion.

The disentangling washing motion is embodied by a method of controlling rotation of the inner tub 35. Specifically, the inner tub 35 is controlled to alternately rotate in forward and reverse directions so as to disentangle the laundry m received in the inner tub 35.

In this case, the rate of rotation of the inner tub 35 may be controlled to allow the laundry m to be adhered to the inner surface of the inner tub 35 by centrifugal force. In this way, the laundry m is adhered to the inner surface of the inner tub 35 for an interval during which the inner tub 35 maintains forward or reverse rotation thereof and is separated from the inner surface of the inner tub 35 for an interval during which the rotation direction of the inner tub 35 is changed. As the laundry m is repeatedly adhered to and separated from the inner surface of the inner tub 35, the laundry m is circulated as illustrated in FIG. 9, thereby being uniformly distributed within the inner tub 35.

During implementation of the disentangling washing motion, it is possible to measure the distribution of the laundry, i.e. unbalance of the laundry within the inner tub 35 based on rotation of the inner tub 35. The unbalance may be measured by observing output properties of the motor 51 upon acceleration or deceleration of the inner tub 35.

Alternatively, the disentangling washing motion may be performed by repeatedly accelerating and decelerating the inner tub 35 while rotating the inner tub 35 in a given direction, rather than repeatedly rotating the inner tub 35 in forward and reverse directions. Specifically, the inner tub 35 is repeatedly rotated and stopped as power applied to the motor 51 is repeatedly turned on and off. In this case, the laundry is adhered to the inner surface of the inner tub 35 by centrifugal force during rotation of the inner tub 35 and is separated from the inner surface of the inner tub 25 when the inner tub 35 is stationary. As the laundry is repeatedly adhered to and separated from the inner surface of the inner tub 35, the laundry is uniformly distributed within the inner tub 35.

Figure 10:
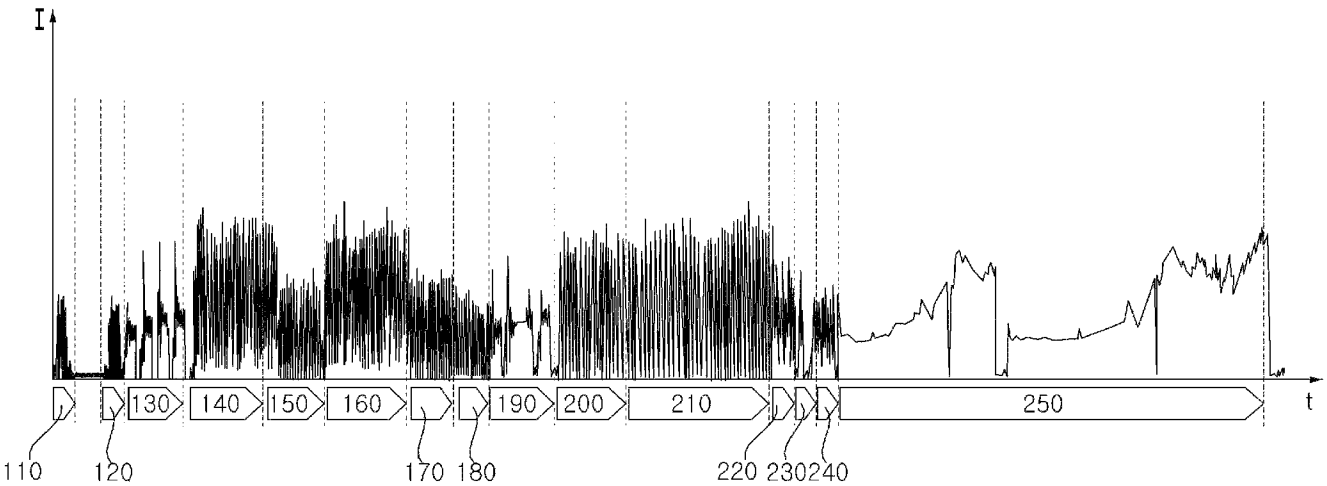
FIG. 10 is a graph illustrating the waveform of current applied to a drive unit during implementation of a washing method according to an embodiment of the present invention.

FIG. 10 is a graph illustrating the waveform of current applied to the drive unit during implementation of a washing method according to an embodiment of the present invention.

Referring to FIG. 10, the washing method of the present invention includes a disentangling washing operation in which the inner tub 35 is alternately rotated in forward and reverse directions to disentangle the laundry received in the inner tub 35, a successive rotating operation in which the inner tub 35 is successively rotated in a given direction such that the laundry in the inner tub 35 is adhered to the inner surface of the inner tub 35 by centrifugal force generated during rotation of the inner tub 35, and an agitation washing operation in which the pulsator 40 is alternately rotated in forward and reverse directions such that the wash water in the inner tub 35 is alternately moved in forward and reverse directions.

Here, the disentangling washing motion as described with reference to FIG. 9 may be performed in the disentangling washing operation, the tapping washing motion as described with reference to FIG. 4 or the penetration washing motion as described with reference to FIG. 7 may be performed in the operation of successively rotating the inner tub 35 in a given direction, and the agitation washing motion as described with reference to FIG. 6 may be performed in the agitation washing operation.

Hereinafter, an embodiment of the washing method according to the present invention will be described in more detail with reference to FIG. 10.

In the washing method according to the embodiment of the present invention, a disentangling washing operation 110 in which the disentangling washing motion and the supply of wash water are performed, a rubbing washing operation 120 in which the rubbing washing motion is performed, a first tapping/penetration washing operation 130 in which the tapping washing motion or the penetration washing motion is performed, and agitation washing operations 140 to 170 in which the agitation washing motion is performed are sequentially performed.

In the following description, it is assumed that a sequence from operation 110 to operation 190 as illustrated in FIG. 10 is performed in a state in which wash water is supplied up to a preset level or less. In this case, the detergent/wash water solution is highly concentrated and thus, this sequence is referred to as high concentration washing.

The agitation washing operations 140 to 170 are divided into first agitation washing operations 140 and 160 in which the drive unit 50 is controlled to a first net acting ratio and second agitation washing operations 150 and 170 in which the drive unit 50 is controlled to a second net acting ratio different from the first net acting ratio.

Here, the net acting ratio is defined by a ratio of an actual driving time of the motor 51 to a total application time of a drive signal from the IPM driver 56 to the motor 51. The drive signal applied to the motor 51 includes an ON-time interval during which current is applied to the motor 51 and an OFF-time interval during which current is not applied to the motor 51.

Accordingly, the net acting ratio may be defined by the following Equation 1.

$$\text{Actual Operating Rate} = \frac{T_{on}}{T_{on} + T_{off}} \qquad \text{Equation 1}$$

In the above Equation 1 , "$T_{on}$" is a signal length in the interval during which current is applied to the motor 51, and "$T_{OFF}$" is a signal length in the interval during which current is not applied to the motor 51.

The control unit 70 applies the drive signal, the ON-time interval and the OFF-time interval of which are set, to the motor 51 by controlling the IPM driver 56, thereby controlling the net acting ratio of the motor 51 and preventing overheating of the motor 51 and the IPM driver 56.

The IPM driver 56 applies the drive signal to the motor 51 in response to a control signal of the control unit 70, thereby rotating the inner tub 35 and/or the pulsator 40 according to the pattern of the ON-time interval and the OFF-time interval included in the drive signal. The IPM driver 56 may rotate the motor 51 forward or reverse.

Here, that the net acting ratio is 1 means that current is continuously applied to the motor 51. Thus, current may be continuously applied to the motor 51 when the rotation direction of the motor 51 is changed between the forward direction and the reverse direction or while the motor 51 is successively rotated in a forward direction. As a result, current may be applied to the motor 51 and the IPM driver 56 for the longest time, resulting in maximum heat emission.

A relationship between the net acting ratio and the waveform of current will now be described in more detail with reference to FIG. 10. In the interval during which a net acting ratio is kept low, the lower limit value of current is close to zero (150, 170, 200 and 210). However, in the interval during which a net acting ratio is kept high, the lower limit value of current is higher than that of the low net acting ratio interval (140 and 160).

The IPM driver 56 is a semiconductor device or a semiconductor integrated circuit to control the supply of current required to drive the motor 51 and has a risk of breakage if the temperature of the IPM driver 56 exceeds a range of 90 to 100 degrees Celsius. Thus, the control unit 70 controls an ON/Off pattern of the drive signal set by current generated by the IPM driver 56 such that the IPM driver 56 does not exceed a temperature range of 90 to 100 degrees Celsius.

In the washing method according to the embodiment of the present invention, after implementation of the first agitation washing operation 140 that is performed at the first net acting ratio, the second agitation washing operation 150 is performed at the second net acting ratio lower than the first net acting ratio, whereby heat emission of the motor 51 and the IPM driver 56 can be effectively controlled. In this case, the first net acting ratio may have a value of 1.

After implementation of the first agitation washing operation 140 and the second agitation washing operation 150, the first agitation washing operation 160 and the second agitation washing operation 170 are repeated, which enables effective control of heat emission from the motor 51 and the IPM driver 56 while obtaining a sufficient time for implementation of the agitation washing operations 140 to 70.

The rate of rotation of the pulsator 40 in the first agitation washing operations 140 and 160 may be higher than the rate of rotation of the second agitation washing operations 150 and 170.

Comparing the rotational velocities of the inner tub 35 in the tapping washing motion, in the penetration washing motion and in the disentangling washing motion with one another under the same conditions, for example, under the same quantity of laundry and the same water level of wash water, the disentangling washing motion has the lowest rate of rotation, and the rate of rotation in the tapping washing motion is higher than that in the penetration washing motion. Accordingly, in FIG. 10, the rate of rotation of the inner tub 35 in the disentangling washing operation 110 is preferably lower than that in the first tapping/penetration washing operation 130.

As a rubbing washing operation 180 and a tapping/penetration washing 190 are performed again after implementation of the second agitation washing operation 170, the high concentration washing is completed.

Subsequent to the high concentration washing, water is additionally supplied up to a preset water level or more, and an agitation washing operation 200 in which the agitation washing motion is performed, an agitation washing operation 210 in which the agitation washing motion is performed at a higher rate of rotation than that in the agitation washing operation 200, a disentangling/shaking washing operation 220 in which the disentangling washing motion or the shaking washing motion is performed, and a tapping/penetration washing operation 230 which is performed at a different net acting ratio from that in the above described tapping/penetration washing operations 130 and 190, and a disentangling/shaking washing operation 240 are sequentially performed.

Here, the agitation washing operations 200 and 210 is performed at a high net acting ratio (for example, at a value of 1) to strongly agitate the wash water in the inner tub 35, thereby achieving strong washing effects. The tapping/penetration washing operation 230 is performed at a relatively low net acting ratio, which may reduce heat emission from the IPM driver 56 and the motor 51 that are heated during the agitation washing operations 200 and 210.

The additional supply of water causes the level of wash water in the tapping/penetration washing operation 230 to exceed that of the high concentration washing, which causes the load of the tapping/penetration washing operation 230 to exceed that of the tapping/penetration washing operations 130 and 190 of the high concentration washing. To control heat emission from the IPM driver 56 and the motor 51 due to the increased load, it is preferable to lower the net acting ratio of the tapping/penetration washing operation 230 to below that of the high concentration washing.

Subsequent to the disentangling/shaking washing operation 240, the control unit 70 operates the pump 86 and increases the rate of rotation of the inner tub 35 to enable dehydration of laundry (250).

In the dehydration operation 250, the rate of rotation of the inner tub 35 may be increased in a stepwise manner. To determine when the dehydration operation 250 is initiated, the unbalance of the inner tub 35 may be measured in the preceding tapping/penetration washing operation 240.

Of course, it will be appreciated that, in the respective tapping/penetration washing operations represented by reference numerals 130, 190 and 230, any one of the tapping washing motion and the penetration washing motion may be performed.

In addition, in the respective tapping/penetration washing operations 130, 190 and 230, if it is sensed that wash water is discharged from the outer tub 30 during implementation of the tapping washing motion, the rate of rotation of the inner tub 35 is reduced to perform the penetration washing motion, which causes the wash water to no longer be discharged from the outer tub 30.

It will be appreciated that one of the disentangling washing motion and the shaking washing motion is performed in the disentangling/shaking washing operation disclosed in the specification as designated by reference numeral 230, which is equally applicable to the disentangling/shaking washing operation 240. For example, these disentangling/shaking washing operation may include a shaking operation 230 in which the shaking washing motion is performed and a disentangling operation 240 in which the disentangling washing motion is performed.

In addition, in the washing machine according to an embodiment of the present invention, in addition to supplying wash water by way of the detergent box 60, wash water may be ejected from a spray nozzle (not shown) independent of the detergent box 60. In this case, since the inner tub 35 and the outer tub 30 may have lowered water levels, the penetration washing motion is preferable to the tapping washing motion.

As is apparent from the above description, a washing method of the present invention attempts to wash laundry based on various combinations of a tapping washing motion, a rubbing washing motion, an agitation washing motion, a penetration washing motion, a shaking washing motion and/or a disentangling washing motion, thereby achieving enhanced washing performance.

Further, the washing method of the present invention effectively controls heat emission of a drive unit.

Furthermore, according to the washing method of the present invention, with a combination of a washing course using movement of wash water and a washing course using mechanical force caused by friction between a pulsator and laundry, enhanced washing efficiency can be accomplished with less damage to laundry.

Although the exemplary embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A washing method of a washing machine comprising an outer tub in which wash water is received, an inner tub rotatably provided in the outer tub such that wash water and laundry are received therein, and a pulsator rotatably provided in a lower region of the inner tub, the washing method comprising high concentration washing; and subsequent to the high concentration washing, low concentration washing, wherein the high concentration washing comprises:

supplying wash water with detergent into the outer tub until the wash water reaches a first preset water level, a disentangling washing operation during which the inner tub is alternately rotated in forward and reverse directions to disentangle the laundry received in the inner tub;

a tapping washing operation during which the inner tub is successively rotated in a given direction such that the laundry is adhered to the inner surface of the inner tub and the wash water is raised along a path between the outer tub and the inner tub to thereby flow into the inner tub by centrifugal force generated during rotation of the inner tub; and an agitation washing operation during which the inner tub is stopped from rotating and the pulsator is alternately rotated in forward and reverse directions, and wherein the low concentration washing comprises:

additionally supplying wash water into the outer tub until the wash water reaches a second preset water level; and rotating at least one of the inner tub and the pulsator.

2. The washing method according to claim 1, wherein the high concentration washing further comprises a rubbing washing operation, subsequent to the agitation washing operation, during which the pulsator is alternately rotated in forward and reverse directions at a velocity lower than that in the agitation washing operation.

3. The washing method according to claim 1, wherein the agitation washing operation includes a first agitation washing operation and a second agitation washing operation, during which a drive unit to supply drive power required to rotate the pulsator is controlled at different net acting ratios.

4. The washing method according to claim 3, wherein the second agitation washing operation is performed subsequent to the first agitation washing operation, and the net acting ratio of the second agitation washing operation is less than the net acting ratio of the first agitation washing operation.

5. The washing method according to claim 4, wherein the net acting ratio of the first agitation operating operation has a value of 1.

6. The washing method according to claim 1, wherein the low concentration washing includes:

an agitation washing operation to alternately rotate the pulsator in forward and reverse directions; and a disentangling washing operation, subsequent to the agitation washing operation, during which the inner tub is alternately rotated in forward and reverse directions such that the laundry received in the inner tub is disentangled.

7. The washing method according to claim 1, wherein the low concentration washing includes:

an agitation washing operation during which the pulsator is alternately rotated in forward and reverse directions; and a shaking washing operation, subsequent to the agitation washing operation, during which the pulsator is rotated in forward and reverse directions at a lower velocity than that in the agitation washing operation.

* * * * *